US005576268A

United States Patent [19]

Burberry et al.

[11] Patent Number: 5,576,268

[45] Date of Patent: Nov. 19, 1996

[54] LASER RECORDING ELEMENT

[75] Inventors: Mitchell S. Burberry, Webster; Bruce C. Campbell, Rochester, both of N.Y.

[73] Assignee: Eastman Kodak Company, Rochester, N.Y.

[21] Appl. No.: 633,397

[22] Filed: Apr. 16, 1996

[51] Int. Cl.[6] ..... B41M 5/035; B41M 5/38

[52] U.S. Cl. ..... 503/227; 428/195; 428/216; 428/315.5; 428/315.7; 428/315.9; 428/913; 428/914; 430/201; 430/269; 430/944; 430/945

[58] Field of Search ..... 8/471; 428/195, 428/212, 213, 215, 216, 304.4, 315.5, 315.7, 315.9, 913, 914; 430/201, 269, 944, 945; 503/227

[56] References Cited

U.S. PATENT DOCUMENTS 5,244,861 9/1993 Campbell et al. ..... 503/227

5,330,876 7/1994 Kaszczuk et al. ..... 430/269

*Primary Examiner*—B. Hamilton Hess

*Attorney, Agent, or Firm*—Harold E. Cole

[57] ABSTRACT

A laser recording element comprising a base having thereon a dye layer comprising an image dye dispersed in a polymeric binder, the dye layer having an infrared-absorbing material associated therewith, the base comprising a composite film laminated to at least one side of a support, the dye layer being on the composite film side of the base, and the composite film comprising a microvoided thermoplastic core layer and at least one substantially void-free thermoplastic surface layer.

11 Claims, No Drawings

LASER RECORDING ELEMENT

This invention relates to a laser recording element, and more particularly to a single-sheet laser recording element wherein the support is a microvoided composite film.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen.

U.S. Pat. No. 5,244,861 relates a receiving element useful in the above-described thermal dye transfer process which contains a microvoided composite film as the support. There is no disclosure in this patent that the support would be useful in other thermal systems.

Another way to thermally obtain a print using the electronic signals described above is to use a laser instead of a thermal printing head. In such a laser transfer system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to a receiver. The absorbing material may be present in a layer beneath the dye and/or it may be admixed with the dye. The laser beam is modulated by electronic signals which are representative of the shape and-color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In another mode of imaging using a laser beam, a laser recording element with a dye layer composition comprising an image dye, an infrared-absorbing material, and a binder coated onto a substrate is imaged from the dye side. The energy provided by the laser drives off the image dye and other components of the dye layer at the spot where the laser beam impinges upon the element. In "laser removal" imaging, the laser radiation causes rapid local changes in the imaging layer, thereby causing the material to be removed from the layer. Usefulness of such a laser recording element is largely determined by the efficiency at which the imaging dye can be removed on laser exposure. The transmission Dmin value is a quantitative measure of dye clean-out: the lower its value at the recording spot, the more complete is the attained dye removal.

U.S. Pat. No. 5,330,876 relates to a dye ablative recording element as described above. The element comprises a support having thereon a dye layer containing an image dye, IR-absorbing dye and binder. The element is imagewise-exposed by a laser and portions of the dye layer are ablated away to produce a dye image. The support for this element is the conventional supports used in this field.

There is a problem with the above dye ablative recording elements in that the minimum density and speed are not as good as is desired.

It is an object of this invention to provide a dye ablative recording element wherein the minimum density and speed are improved over that of the prior art. It is another object of this invention to provide a process for forming an image using this recording element.

These and other objects are achieved in accordance with the invention which relates to a laser recording element comprising a base having thereon a dye layer comprising an image dye dispersed in a polymeric binder, the dye layer having an infrared-absorbing material associated therewith, the base comprising a composite film laminated to at least one side of a support, the dye layer being on the composite film side of the base, and the composite film, comprising a microvoided thermoplastic core layer and at least one substantially void-free thermoplastic surface layer.

Any visible image dye can be used in the laser recording element employed in the invention provided it can be removed by the action of the laser. Especially good results have been obtained with dyes such as anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, (products of Nippon Kayaku Co., Ltd.); direct dyes such as Direct Dark Green B® (product of Mitsubishi Chemical Industries, Ltd.) and Direct Brown M® (product of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.);

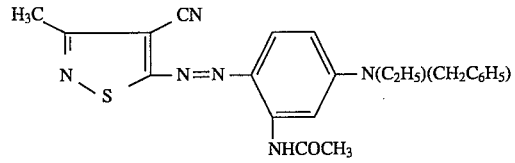

(magenta)

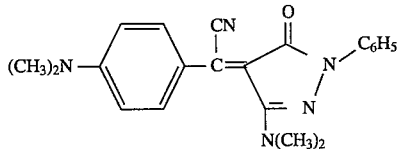

(magenta)

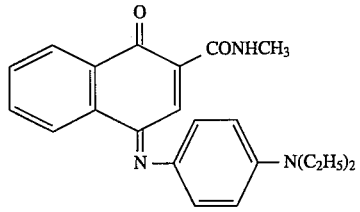

(cyan-1)

-continued

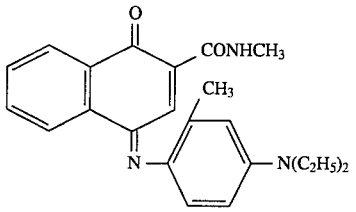

(cyan-2)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

Another embodiment of the invention relates to a process of forming a dye image comprising imagewise-heating, by means of a laser, the recording element described above, the laser exposure taking place through the dye side of the element and causing dye to be removed imagewise to obtain the dye image in the recording element.

In still another preferred embodiment of the invention, dye is removed imagewise by means of an air stream, vacuum and filter system.

The laser recording elements of this invention can be used to obtain medical images, reprographic masks, printing masks, etc. The image obtained can be a positive or a negative image. The dye removal process can generate either continuous (photographic-like) or halftone images.

Any polymeric material may be used as the binder in the recording element employed in the invention. For example, there may be used cellulosic derivatives, e.g., cellulose nitrate, cellulose acetate hydrogen phthalate, cellulose acetate, cellulose acetate propionate, cellulose acetate butyrate, cellulose triacetate, a hydroxypropyl cellulose ether, an ethyl cellulose ether, etc., polycarbonates; polyurethanes; polyesters; poly(vinyl acetate); polystyrene; poly(styrene-co-acrylonitrile); a polysulfone; a poly(phenylene oxide); a poly(ethylene oxide); a poly(vinyl alcohol-co-acetal) such as poly(vinyl acetal), poly(vinyl alcohol-co-butyral) or poly(vinyl benzal); or mixtures or copolymers thereof. The binder may be used at a coverage of from about 0.1 to about 5 g/m$^2$.

In a preferred embodiment, the polymeric binder used in the recording element employed in the process of the invention has a polystyrene equivalent molecular weight of at least 100,000 as measured by size exclusion chromatography, as described in U.S. Pat. No. 5,330,876, the disclosure of which is hereby incorporated by reference.

A barrier layer may be employed in the laser recording element of the invention if desired, as described in copending U.S. Ser. No. 321,282, filed Oct. 11, 1994, and entitled BARRIER LAYER FOR LASER ABLATIVE IMAGING, the disclosure of which is hereby incorporated by reference.

To obtain a laser-induced image according to the invention, a diode laser is preferably employed, such as an infrared diode laser, since it offers substantial advantages in terms of its small size, low cost, stability, reliability, ruggedness, and ease of modulation. In practice, before an infrared laser can be used to heat a recording element, the element must contain an infrared-absorbing material, such as cyanine infrared-absorbing dyes as described in U.S. Ser. No. 099,969, filed Jul. 30, 1993, and entitled, "INFRARED-ABSORBING CYANINE DYES FOR LASER ABLATIVE IMAGING" or other materials as described in the following U.S. Pat. No. : 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared-absorbing dye may be contained in the dye layer itself or in a separate layer associated therewith, i.e., above or below the dye layer. Preferably, the laser exposure in the process of the invention takes place through the dye side of the recording element, which enables this process to be a single-sheet process, i.e., a separate receiving element is not required.

Lasers which can be used in the invention are available commercially. There can be employed, for example, Laser Model SDL-2420-H2 from Spectra Diode Labs, or Laser Model SLD 304 V/W from Sony Corp.

The dye layer of the laser recording element of the invention may be coated on the support or printed thereon by a printing technique such as a gravure process or a hopper coater.

Due to their relatively low cost and good appearance, composite films are generally used and referred to in the trade as "packaging films." The support may include cellulose paper, a polymeric film or a synthetic paper.

Unlike synthetic paper materials, microvoided packaging films can be laminated to one side of most supports and still show excellent curl performance. Curl performance can be controlled by the beam strength of the support. As the thickness of a support decreases, so does the beam strength. These films can be laminated on one side of supports of fairly low thickness/beam strength and still exhibit only minimal curl.

Microvoided composite packaging films are conveniently manufactured by coextrusion of the core and surface layers, followed by biaxial orientation, whereby voids are formed around void-initiating material contained in the core layer. Such composite films are disclosed in, for example, U.S. Pat. No. 5,244,861, the disclosure of which is incorporated by reference.

The core of the composite film should be from 15 to 95% of the total thickness of the film, preferably from 30 to 85% of the total thickness. The nonvoided skin(s) should thus be from 5 to 85% of the film, preferably from 15 to 70% of the thickness. The density (specific gravity) of the composite film should be between 0.2 and 1.0 g/cm$^3$, preferably between 0.3 and 0.7 g/cm$^3$. As the core thickness becomes less than 30% or as the specific gravity is increased above 0.7 g/cm$^3$, the composite film starts to lose useful compressibility and thermal insulating properties. As the core thickness is increased above 85% or as the specific gravity becomes less than 0.3 g/cm$^3$, the composite film becomes less manufacturable due to a drop in tensile strength and it becomes more susceptible to physical damage. The total thickness of the composite film can range from 20 to 150 μm, preferably from 30 to 70 μm. Below 30 μm, the microvoided films may not be thick enough to minimize any inherent non-planarity in the support and would be more difficult to manufacture. At thicknesses higher than 70 μm, little improvement in either print uniformity or thermal efficiency is seen, and so there is not much justification for the further increase in cost for extra materials.

Suitable classes of thermoplastic polymers for the core matrix-polymer of the composite film include polyolefins, polyesters, polyamides, polycarbonates, cellulosic esters, polystyrene, polyvinyl resins, polysulfonamides, polyethers, polyimides, poly(vinylidene fluoride), polyurethanes, poly(phenylene sulfides), polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene,[I] and mixtures thereof. Polyolefin copolymers, including copolymers of ethylene and propylene are also useful.

The composite film can be made with skin(s) of the same polymeric material as the core matrix, or it can be made with skin(s) of polymeric composition different from that of the core matrix. For compatibility, an auxiliary layer can be used to promote adhesion of the skin layer to the core.

Addenda may be added to the core matrix to improve the whiteness of these films. This would include any process which is known in the art including adding a white pigment, such as titanium dioxide, barium sulfate, clay, or calcium carbonate. This would also include adding optical brighteners or fluorescing agents which absorb energy in the UV region and emit light largely in the blue region, or other additives which would improve the physical properties of the film or the manufacturability of the film.

Coextrusion, quenching, orienting, and heat setting of these composite films may be effected by any process which is known in the art for producing oriented film, such as by a flat film process or by a bubble or tubular process. The flat film process involves extruding the blend through a slit die and rapidly quenching the extruded web upon a chilled casting drum so that the core matrix polymer component of the film and the skin components(s) are quenched below their glass transition temperatures (Tg). The quenched film is then biaxially oriented by stretching in mutually perpendicular directions at a temperature above the glass transition temperature of the matrix polymers and the skin polymers. The film may be stretched in one direction and then in a second direction or may be simultaneously stretched in both directions. After the film has been stretched it is heat set by heating to a temperature sufficient to crystallize the polymers while restraining the film to some degree against retraction in both directions of stretching.

By having at least one nonvoided skin on the microvoided core, the tensile strength of the film is increased and makes it more manufacturable. It allows the films to be made at wider widths and higher draw ratios than when films are made with all layers voided. Coextruding the layers further simplifies the manufacturing process.

The support to which the microvoided composite films are laminated for the base of the recording element of the invention may be a polymeric, synthetic paper, or cellulose fiber paper support, or laminates thereof.

Preferred cellulose fiber paper supports include those disclosed in U.S. Pat. No. 5,250,496, the disclosure of which is incorporated by reference. When using a cellulose fiber paper support, it is preferable to extrusion laminate the microvoided composite films using a polyolefin resin. During the lamination process, it is desirable to maintain minimal tension of the microvoided packaging film in order to minimize curl in the resulting laminated support. The backside of the paper support (i.e., the side opposite to the microvoided composite film) may also be extrusion coated with a polyolefin resin layer (e.g., from about 10 to 75 g/m$^2$), and may also include a backing layer such as those disclosed in U.S. Pat. Nos. 5,011,814 and 5,096,875, the disclosures of which are incorporated by reference. For high humidity applications (>50% RH), it is desirable to provide a backside resin coverage of from about 30 to about 75 g/m$^2$, more preferably from 35 to 50 g/m$^2$, to keep curl to a minimum.

In one preferred embodiment, in order to produce recording elements with a desirable photographic look and feel, it is preferable to use relatively thick paper supports (e.g., at least 120 μm thick, preferably from 120 to 250 μm thick) and relatively thin microvoided composite packaging films (e.g., less than 50 μm thick, preferably from 20 to 50 μm thick, more preferably from 30 to 50 μm thick).

In another embodiment of the invention, in order to form a recording element which resembles plain paper, e.g. for inclusion in a printed multiple page document, relatively thin paper or polymeric supports (e.g., less than 80 μm, preferably from 25 to 80μm thick) may be used in combination with relatively thin microvoided composite packaging films (e.g., less than 50 μm thick, preferably from 20 to 50 μm thick, more preferably from 30 to 50 μm thick).

The following example is provided to further illustrate the invention.

EXAMPLE

Preparation of the Microvoided Support-Support A

A commercially available packaging film (OPPalyte® 350 TW, Mobil Chemical Co.) was laminated to a paper support. OPPalyte® 350 TW is a composite film (38 μm thick) (d=0.62) consisting of a microvoided and oriented polypropylene core (approximately 73% of the total film thickness), with a titanium dioxide pigmented, non-microvoided, oriented polypropylene layer on each side; the void-initiating material is poly(butylene terephthalate).

Packaging films may be laminated in a variety of way (by extrusion, pressure, or other means) to a paper support. In the present context, they were extrusion-laminated as described below with pigmented polyolefin onto a paper stock support. The pigmented polyolefin was polyethylene (12 g/m$^2$) containing anatase (titanium dioxide) (12.5% by weight) and a benzoxazole optical brightener (0.05% by weight).

The paper stock support was 137 μm thick and made form a 1:1 blend of Pontiac Maple 51 (a bleached maple hardwood kraft of 0.5 μm length weighted average fiber length), available from Consolidated Pontiac, Inc., and Alpha Hardwood Sulfite (a bleached red-alder hardwood sulfite of 0.69 μm average fiber length), available form Weyerhauser Paper Co. The backside of the paper stock support was coated with high-density polyethylene (30 g/m$^2$).

Preparation of the Non-micrivided Support-Support B (Control)

A non-microvoided support was prepared by extrusion-coating a pigmented polyolefin unto a paper stock support. The pigmented polyolefin was polyethylene (12 g/m$^2$) containing anatase (titanium dioxide) (12.5% by weight) and a benzoxazole optical brightener (0.05% by weight). The paper stock support was the same as described above. The backside of the paper stock support was coated with high-density polyethylene (30 g/m$^2$).

Laser Dye Ablation Layer

The following mixture was prepared and stirred until dissolved:

12 g nitrocellulose (Hercules)

0.24 g IR-1

0.24 g of cyan-2 dye illustrated above 70 g acetone

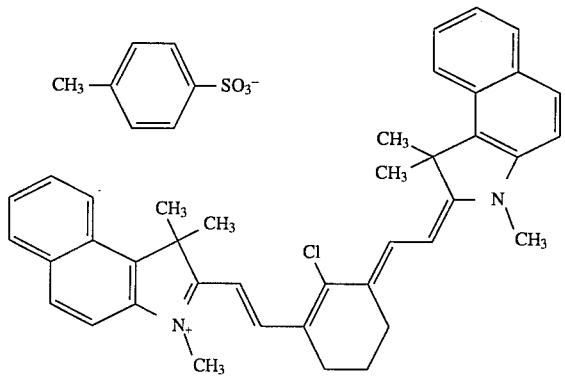

IR-Absorbing Dye IR-1

Element 1

The above solution was coated at 34 g/m$^2$, wet coverage, on paper Support A as described above.

Control 1

This is similar to Element 1 except that Support B was used instead of Support A.

Laser Exposure

After drying, the elements were exposed using Spectra Diode Labs Lasers Model SDL-2432, with a maximum power of 600 mW per laser beam, at 830 nm, 1000 rev/min and a spot size of approximately 12 μm × 25 μm using a lathe type printer with a drum circumference of 53 cm. The diode laser beams were scanned across the surface of the element to achieve 945 lines per cm, or 2400 lines per in. An air stream was blown over the donor surface along with a vacuum and a filter system to remove the ablated material.

A step tablet image was printed by reducing the laser intensity linearly in successive patches from the maximum to 0. Reflection Status A red densities were measured using an X-Rite Model 310 reflection densitometer.

Readings were referenced to the uncoated paper support, respectively. The results are given in the following Table. The closely matched D-max values indicate that the coating thicknesses were the same within experimental error as intended (step 21).

TABLE

| Step | Laser Power (mW) | Exposure (mJ/cm$^2$) | Element 1 | Control 1 |
|---|---|---|---|---|
| 1 | 600 | 643 | 0.12 | 0.21 |
| 2 | 585 | 627 | 0.12 | 0.21 |
| 3 | 570 | 611 | 0.12 | 0.21 |
| 4 | 555 | 595 | 0.12 | 0.21 |
| 5 | 540 | 578 | 0.12 | 0.21 |
| 6 | 525 | 562 | 0.13 | 0.23 |
| 7 | 510 | 546 | 0.13 | 0.24 |
| 8 | 495 | 530 | 0.13 | 0.25 |
| 9 | 480 | 514 | 0.14 | 0.26 |
| 10 | 465 | 498 | 0.15 | 0.26 |
| 11 | 450 | 482 | 0.15 | 0.30 |
| 12 | 435 | 466 | 0.16 | 0.32 |
| 13 | 420 | 450 | 0.17 | 0.35 |
| 14 | 405 | 434 | 0.19 | 0.38 |
| 15 | 390 | 418 | 0.22 | 0.40 |
| 16 | 375 | 402 | 0.25 | 0.44 |
| 17 | 360 | 386 | 0.31 | 0.50 |
| 18 | 345 | 370 | 0.34 | 0.55 |
| 19 | 330 | 354 | 0.43 | 0.59 |

TABLE-continued

| Step | Laser Power (mW) | Exposure (mJ/cm$^2$) | Element 1 | Control 1 |
|---|---|---|---|---|
| 20 | 315 | 337 | 0.53 | 0.67 |
| 21 | 0 | 0 | 0.76 | 0.77 |

The above results show the element with the microvoided support (Element 1) was more efficient, exhibiting a considerably lower D-min (Steps 1–5), than Control 1 which used a non-microvoided support. The microvoided support also gave a speed improvement which can be seen in the data by defining a speed point as the exposure required to print to 0.03 above D-min (step 10 for Element 1 and step 7 for Control 1). The speed point for Element 1 was 498 mJ/cm$^2$, while the speed point for Control 1 was 546 mJ/cm$^2$. Thus, Element 1 requires 9% less exposure to achieve this speed point.

The invention has been described in detail with particular reference to preferred embodiments thereof, but it will be understood that variations and modifications can be effected within the spirit and scope of the invention.

What is claimed is:

1. A laser recording element comprising a base having thereon a dye layer comprising an image dye dispersed in a polymeric binder, said dye layer having an infrared-absorbing material associated therewith, said base comprising a composite film laminated to at least one side of a support, said dye layer being on the composite film side of said base, and said composite film comprising a microvoided thermoplastic core layer and at least one substantially void-free thermoplastic surface layer.

2. The element of claim 1 wherein the thickness of said composite film is from 30 to 70 μm.

3. The element of claim 1 wherein said core layer of said composite film comprises from 30 to 85% of the thickness of said composite film.

4. The element of claim 1 wherein said composite film comprises a microvoided thermoplastic core layer having a substantially void-free thermoplastic surface layer on each side thereof.

5. The element of claim 1 wherein said support comprises paper.

6. The element of claim 5 wherein said paper support is from 120 to 250 μm thick and said composite film is from 30 to 50 μm thick.

7. The element of claim 6 further comprising a polyolefin backing layer on the side of said support opposite to said composite film.

8. The element of claim 1 wherein said infrared-absorbing material is a dye.

9. A process of forming a dye image comprising imagewise-heating, by means of a laser, the laser recording element of claim 1, said laser exposure taking place through the dye side of said element, and causing dye to be removed imagewise to obtain said dye image in said recording element.

10. The process of claim 9 wherein said dye is removed imagewise by means of an air stream, vacuum and filter system.

11. The process of claim 9 wherein said laser is a diode laser.

* * * * *